US005342651A

United States Patent [19]

Usui et al.

[11] Patent Number: 5,342,651

[45] Date of Patent: Aug. 30, 1994

[54] METHOD FOR MANUFACTURING MODIFIED WOOD

[75] Inventors: Hiroaki Usui; Shozo Hirao; Satoru Konishi; Hiroyuki Ishikawa; Kenji Oonisi; Arihiro Adachi, all of Kadoma, Japan

[73] Assignee: Matsushita Electric Works, Ltd., Osaka, Japan

[21] Appl. No.: 127,376

[22] Filed: Sep. 28, 1993

Related U.S. Application Data

[63] Continuation of Ser. No. 797,068, Nov. 25, 1991, abandoned.

[30] Foreign Application Priority Data

Nov. 27, 1990 [JP] Japan ..... 3-213989

[51] Int. Cl.[5] ..... B05D 1/00

[52] U.S. Cl. ..... 427/209; 156/152; 427/325; 427/340; 427/343; 428/420

[58] Field of Search ..... 156/152, 310, 314, 319, 156/308.8; 29/426.2, 458; 428/420; 427/209, 325, 340, 343

[56] References Cited

U.S. PATENT DOCUMENTS 2,468,086 4/1949 Latham et al. ..... 427/325
4,857,365 8/1989 Hirao et al. .

FOREIGN PATENT DOCUMENTS 1-166903 6/1989 Japan .

*Primary Examiner*—John J. Gallagher
*Attorney, Agent, or Firm*—Burns, Doane, Swecker & Mathis

[57] ABSTRACT

A method for manufacturing a modified wood prepares a natural wood material containing more than a predetermined amount of a solvent for dissolving two different compounds which chemically react with each other to form an insoluble compound, provides a layer of each of the different compounds inside each of two opposing surfaces of the wood material, causes the different compounds to chemically react with each other within the wood material and fixes the formed insoluble compound in the wood material, whereby the fixation amount of the insoluble compound in the wood can be effectively increased.

11 Claims, 3 Drawing Sheets

METHOD FOR MANUFACTURING MODIFIED WOOD

This application is a continuation of application Ser. No. 07/797,068, filed Nov. 25, 1991, now abandoned.

BACKGROUND OF THE INVENTION

This invention relates to a method for manufacturing a modified wood with an insoluble compound impregnated therein.

The modified wood obtained according to the invention is provided with one of nonflammability, rotproof and mothproof properties, water and water-vapor resistance, dimensional stability, surface rigidness, wearing properties or the like, so as to be effectively utilized as construction material and so on.

DESCRIPTION OF RELATED ART

In manufacturing modified wood having one of the above properties, there have been practiced various methods of attaining a composite member of insoluble and nonflammable inorganic substance with natural wood, or of a functioning resin with the natural wood, an ornamentation of natural wood with a chemical agent by means of a reaction between cellulose and a chemical substance, an impregnation of the natural wood with pharmaceutical preparations and so on. With the composite member of the insoluble, nonflammable inorganic substance with the natural wood, a modified wood provided with a nonflammability or flame retardancy reaching a quasi-nonflammability level according to Japanese Industrial Standard (JIS), rotproof and mothproof properties and surface rigidness can be realized as a material for fireproof doors and so on. With the composite member of the functional resin with natural wood, the natural wood has mainly water and water-vapor resistance, surface rigidness, dynamic reinforcement and wearing properties, so as to be generally widely utilized as, for example, WPC flooring and so on. In the case of the ornamentation of wood with the chemical agent, it is made possible to realize provisions to the wood mainly of the water and water-vapor resistance as well as the dimensional stability so that the wood modified by acetylation, for example, can be adapted for use in a bath room, kitchen or the like where much water is used. When natural wood is impregnated with a pharmaceutical preparation, the wood has rotproof and mothproof properties and it can be employed as general house constructional material.

Further, impregnation by means immersing of the wood into the pharmaceutical preparation optionally by chemical reaction and fixation of a reaction product within the wood by means of repeated immersion into the pharmaceutical preparation, can be executed under vacuumed or pressurized atmosphere conditions and in a so-called batch processing system.

In U.S. Pat. No. 4,857,365 to S. Hirao et al assigned to the present assignee, for example, there has been disclosed a method of fixing an insoluble, nonflammable inorganic substance within the wood through a reaction between cations and anions by sequentially immersing the raw wood material into two different solutions such as a water-soluble inorganic substance solution containing cations and a further water-soluble inorganic substance solution containing anions. According to this method, there can be provided a modified wood having a function dependent on the inorganic substance solutions employed. In this method of Hirao at al, however, there a problem that the reaction between cations and anions occurs outside the wood material due to mixing before entering into the wood when this material, after being immersed in one of the two different inorganic substance solutions, is immersed next in the other inorganic substance solution. Both solutions will then be contaminated thereby shortening the useful immersion time. Further, when the batch processing system is employed in the method of Hirao at al, it is required to repeatedly execute such steps as preparations of the inorganic substance solutions, and there has been involving a drawback that the production efficiency cannot be elevated with this method of Hirao et al, in attaining a mass production.

In order to eliminate the foregoing problems of the U.S. patent to Hirao et al, there has been suggested by Y. Ishikawa et al in Japanese Patent Laid-Open Publication No. 1-166903 a method for manufacturing a modified wood by spreading onto one surface of the wood material to be modified a cation-containing inorganic substance solution to impregnate the wood with the solution, and spreading onto the other surface of the same wood material an anion-containing inorganic substance solution so as to cause a reaction between cations and anions to take place and reaction product to be fixed inside the wood. With this method, however, the mere spreading for impregnation of the inorganic substance solution of a relatively low viscosity to the surfaces of the wood material results in a flow of the most of the solution out of the surfaces so long as the solution is spread within a short time even in a larger amount, and impregnated amounts of the solutions in the respective surfaces is limited. Consequently, the fixation of the insoluble inorganic substance inside the wood material is also insufficient. Thus, the problem still remains of attaining improvements in function in accordance with the type of the insoluble inorganic substance fixed in the wood material, that is, in the inflammability, rotproof and mothproof properties, water and water-vapor resistance, dimensional stability, surface rigidness, dynamical reinforcement or wearing properties.

SUMMARY OF THE INVENTION

A primary object of the present invention is, therefore, to provide a method for manufacturing a modified wood which is remarkably increased in the fixation amount of the insoluble compound within the wood material and is thus capable of sufficiently attaining the function corresponding to the insoluble compound.

According to the present invention, this object can be achieved by a method for manufacturing a modified wood in which a chemical reaction between mutually different compounds takes place within natural wood material for fixation therein of an insoluble compound, characterized by the steps of preparing the natural wood material containing a solvent to which two different compounds are soluble, forming a layer of each of the different compounds on each of mutually opposing surfaces of the wood material pieces containing the solvent, and curing the wood material in which the layers of the different compounds are formed.

Other objects and advantages of the present invention shall be clarified in the following description of the invention detailed with reference to an embodiment of the invention.

Figure 1:
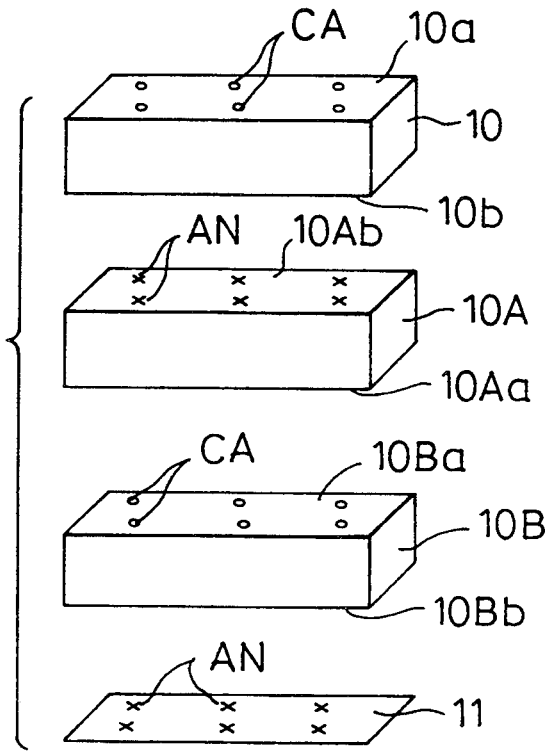
FIGS. 1 to 4 are explanatory views for the steps of manufacturing the modified wood according to the present invention.

While the present invention shall now be explained with reference to an embodiment of the invention, it should be appreciated that the intention is not to limit the invention only to the embodiment herein disclosed but rather to include all modifications, alterations and equivalent arrangements possible within the scope of appended claims.

DETAILED DESCRIPTION OF THE PREFERRED EMBODIMENT

The natural wood material to be modified (which shall be referred to simply as "wood" hereinafter) and used in the present invention is not required to be particularly limited, and includes lumber, sliced veneer, and plywood. It is preferable that the wood has in one dimension a sufficiently larger surface than the surface area of another dimension, e.g., thickness for forming on which surface a compound layer as will be detailed later. Further, the species of wood is not particularly limited.

According to a remarkable feature of the present invention, the method is provided for increasing a fixation amount of the insoluble compound in the interior of the wood, i.e., in the wood structure. While the types of compounds used for forming the insoluble compound are not particularly limited, there may be enumerated, when the insoluble compound is, for example, an inorganic compound, such alkali earth metals as Mg, Ca, Sr, Ba and the like or Fe, Cu, Co, Ni, Mn, Pb, Zn and the like for the cationic element, and OH, F, Cl, Br, $NO_3$, $CO_3$, $BO_3$, $PO_4$, $SO_4$ and the like for the anionic members. In these inorganic substances, it is also possible to have more than two of them coexist inside the wood. When the insoluble compound is an organic compound, on the other hand, amino resins, epoxy resins, phenolic resins and so on may be employed. The wood is impregnated with such a resin as a main component and a hardening agent or an additive to cause the components to react with each other within the wood. Further, such inorganic and organic agents as has been described may mutually react within the wood.

The compounds used for forming the insoluble compound (which shall be referred to simply as "forming compounds" hereinafter) are optionally selected in accordance with the insoluble compound to be fixed within the wood. In this event, it is desirable that, in order to attain such functions as a high fire resistant property, dimensional stability, dynamic reinforcement, surface rigidness and so on, one of the forming compounds is in a solid state or in a viscous liquid state. With the use of such forming compounds, a larger amount of their adhesion to the surface of the wood can be made attainable so that the fixation amount of the insoluble compound within the wood can be increased. In this case, more than 20 g/ft$^2$ of the forming compounds should preferably be caused to adhere onto the surface of the wood, while these compounds should preferably be in a powdery or particulate state, a mixture in a slurry state of a solid member and a solvent, or a viscous liquid showing a viscosity more than 5000 cP.

In modifying the wood, the wood is first made to contain sufficient amount of solvent to which the forming compounds for the insoluble compound are soluble, by means of an impregnating process or the like. The solvent content in the wood should be optimumly at least more than 80% with respect to the absolute dry weight of the wood or, more desirably 120% by the solvent. Further, when the wood with the forming compounds made to adhere thereto is placed within an atmosphere of the solvent under a high humidity conditions for curing the solution of the forming compounds is remarkably promoted, and eventually the fixation amount of the insoluble compound within the wood can be well increased. For the solvent impregnating process, it will be possible to employ such a measure as, when the solvent is water, for example, underwater storage, steaming, vacuum impregnation, pressurized impregnation or the like.

Figure 2:
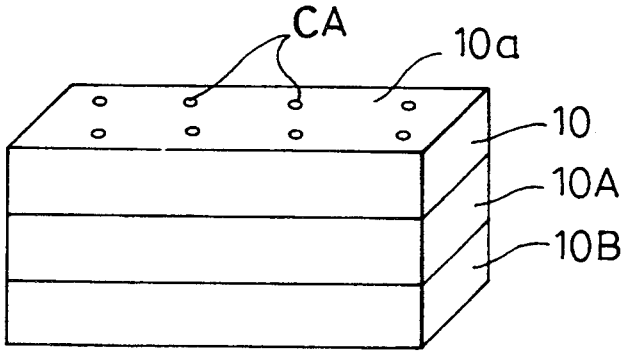
Figure 3:
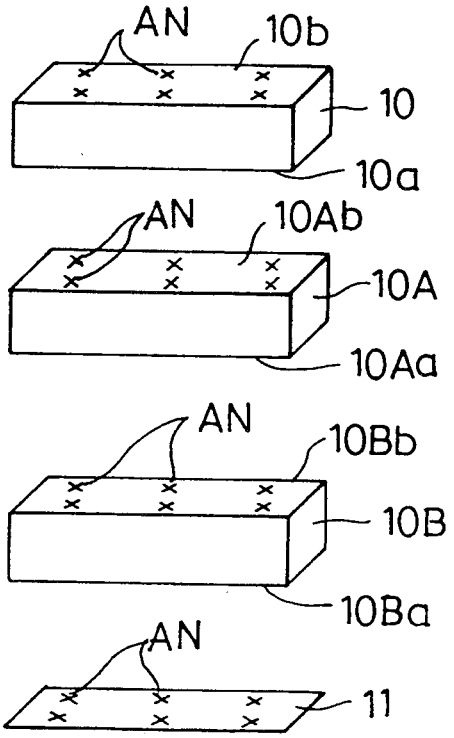
Figure 4:
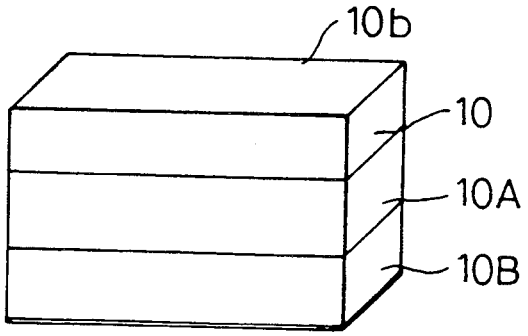

Thereafter, in the event where the insoluble inorganic compound is to be fixed within the wood, a cation-containing forming compound CA is made to adhere to one side surfaces 10*a*, 10Aa and 10Ba of a plurality of the woods 10, 10A and 10B while an anion-containing forming compound AN is made to adhere to the other side surfaces 10*b*, 10Ab and 10Bb of the respective woods 10, 10A and 10B as shown in FIG. 1, and these woods 10, 10A and 10B are then stacked on each other with their same forming-compound carrying surfaces 10*b* and 10Ab as well as 10Aa and 10Ba opposed to each other as shown in FIG. 2. Here, it may be also possible to spread alternately the cation-containing and anion-containing forming compounds CA and AN onto only one side surfaces of the respective woods 10, 10A and 10B, and, in this event, the one side surface 10*a* of the wood 10 will have, for example, the cation-containing forming compound, while the one side surface 10Aa of the next wood 10A is made to have a double amount of the anion-containing forming compound AN and the one side surface 10Ba of the further wood 10B carries a double amount of the cation-containing forming compound CA so that these enlarged amount of the compounds AN and CA will be partly transferred to opposing surfaces on the other side of the woods when they are stacked. Keeping the thus stacked state, these woods are subjected to a curing process while keeping the wood not to be dried, with such solvent as water within the wood prevented from being caused to volatilize. Then, the respective woods 10, 10A and 10B in the stack are once disassembled as shown in FIG. 3 and the first and third woods 10 and 10B are turned over by 180 degrees, desirably, so that the other forming-compound carrying surfaces 10*a* and 10Ab as well as 10Aa and 10Bb will be opposed to each other as seen in FIG. 3, and the thus turned woods are again stacked as shown in FIG. 4 to be subjected to the curing process in the same manner as in the above. In stacking the woods as in the above, it is desirable to attach a sheet of vinyl 11 carrying the same forming compound as that on the other side surface 10Bb of the lowermost positioned wood 10B as shown in FIGS. 1 and 2, or the sheet of vinyl 11 carrying the different forming compound from that on the one side surface 10Ba of the lowermost positioned wood 10B as shown in FIGS. 3 and 4.

Figure 5:
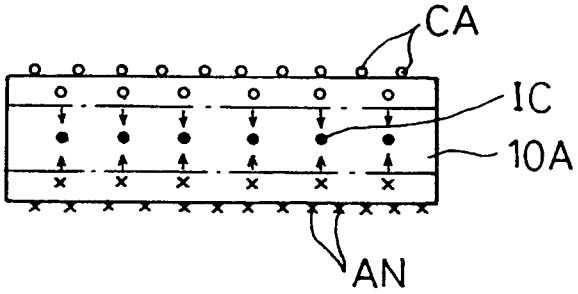
FIG. 5 is an explanatory view of process through which the insoluble compound is produced in the manufacturing steps of FIGS. 1 to 4.
Figure 6:
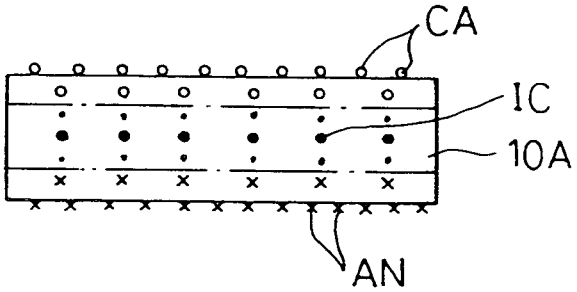
FIG. 6 is an explanatory view for a state in which the insoluble compound is produced in the manufacturing steps of FIGS. 1 to 4.

With these woods 10, 10A and 10B respectively carrying on the both opposite side surfaces the different forming compounds adhering thereto stacked and cured as in the above, the mutually different forming compounds are caused to be contained to an extent of forming a layer of each compound in each of the surfaces of the respective woods as shown in FIG. 5 typically by the wood 10A. Consequently, as shown in FIG. 6, the mutually different forming compounds CA and AN are caused to meet to react with each other within the wood extremely excellently, so that the insoluble inorganic compound IC is to be formed in a larger amount. While the description has been made with reference to FIGS. 1 through 4 showing three of the woods stacked, the number of the stacked wood may freely be increased or decreased.

EXAMPLE 1

10 sheets of rotary-cut agatis veneers of 30 cm long, 30 cm wide and 0.3 cm thick respectively were employed as the wood, and these veneers were immersed in hot water until their saturated state was reached. Then, $(NH_4)_2HPO_4$ as the anion-containing forming compound was spread over a vinyl sheet at a rate of 35 g/ft$^2$, and first one of the water-saturated veneers was placed on this vinyl sheet. On the top surface of this veneer, $BaCl_2.2H_2O$ as the cation-containing forming compound was uniformly spread at a rate of 130 g/ft$^2$, second water-saturated veneer was further stacked on the foregoing first veneer, and $(NH_4)_2HPO_4$ was uniformly spread over the top surface of this second veneer at a rate of 70 g/ft$^2$. Such stacking of the further veneers as well as the spreading of the cation-containing and anion-containing forming compounds were repeated, and $(NH_4)_2HPO_4$ as the anion-containing forming compound was finally spread over the top surface of the topmost tenth veneer water-saturated at a rate of 35 g/ft$^2$. The thus stacked veneers were kept in a tightly sealed state and cured for one day at a room temperature. Thereafter, the 10 sheets of the stacked veneers were respectively rinsed and dried, and ten sheets of a modified wood were thereby obtained. In this case, $BaCl_2.2H_2O$ as the cation-containing forming compound was made to form a layer of 300–400 μm and $(NH_4)_2HPO_4$ as the anion-containing forming compound was made to be a layer of 250–350 μm on the surfaces of the veneers.

EXAMPLES 2–6

Except for such changes as listed in a following Table I in respect of the presence or absence of the water saturation, species and size of the wood, aspects of the compounds, type, spreading rate and layer thickness of the cation-containing and anion-containing forming compounds and processing conditions for the drying in Example 1, different modified woods were obtained in the same manner as in Example 1. In the present instance, the same rotary-cut veneers as those used in Example 1 were employed in Examples 5 and 6, while block-shaped plates of the wood were employed in Examples 2 to 4 instead of the rotary-cut veneers.

EXAMPLE 7

11 sheets of the rotary-cut agatis veneers of 30 cm long, 30 cm wide and 0.3 cm thick and processed so as not to be saturated with water but to be of a water content of 10–12% were employed as the wood, and first one of these veneers was placed on a vinyl sheet on which $(NH_4)_2HPO_4$ was uniformly spread as the anion-containing forming compound at a rate of 35 g/ft$^2$. On the top surface of this first veneer, $BaCl_2.2H_2O$ as the cation-containing forming compound was uniformly spread at a rate of 130 g/ft$^2$ second one of the veneers was stacked on the first veneer, and $(NH_4)_2HPO_4$ was uniformly spread over the top surface of this second veneer. Such stacking of the further veneers as well as the spreading of the cation-containing and anion-containing forming compounds were repeated, and finally $BaCl_2.2H_2O$ as the cation-containing forming compound was spread uniformly on the top surface of the topmost eleventh veneer at a rate of 65g/ft$^2$. The thus prepared stack of the veneers was placed in a thermo-hygrostat and was subjected to a curing for 24 hours under hot and high humidity conditions of 60° C. and a relative humidity of 95%. Thereafter, these eleven veneers were respectively rinsed and dried, and eleven sheets of a modified wood were obtained. In this case, $BaCl_2.2H_2O$ and $H_3BO_3$ as the cation-containing forming compound was made to form a layer of 1200–1400 μm, and $(NH_4)_2HPO_4$ and $H_3BO_3$ as the anion-containing forming compound was made to be a layer of 750–850 μm on the surfaces of the veneers.

EXAMPLES 8–11

Except for such changes in the various conditions and so on as listed in the following Table I, further modified woods in the form of the veneers were obtained in the same matter as in Example 7.

In the respective foregoing Examples, as will be readily appreciated, the veneers in the stacked state are respectively carrying on one surface the cation-containing forming compound and on the other opposing surface the anion-containing forming compound mutually substantially in the same amount of adhesion.

COMPARATIVE EXAMPLE 1

The rotary-cut agatis wood veneers of 30 cm long, 30 cm wide and 0.3 cm thick and employed as the wood were immersed in hot water until a state saturated with water was reached. The thus water-saturated veneers were immersed for 24 hours in an anion-containing solution at 80° C. of $(NH_4)_2HPO_4$ in a concentration of 3.5 mol per liter and $H_3BO_3$ of 4.0 mol per liter, and were further immersed for 24 hours in a cation-containing solution of $BaCl_2$ of 2.0 mol per liter and $H_3BO_3$ of 2.0 mol per liter, and the respective veneers were rinsed and dried, and the veneers of a thus modified wood were obtained.

COMPARATIVE EXAMPLE 2

In place of the veneer wood employed in Comparative Example 1, block-shaped hemlock wood plates of 30 cm long, 30 cm wide and 1.5 cm thick were employed, and, except for such changes in the type and concentration as in Table I of the inorganic compounds in the anion-containing and cation-containing solutions, a further modified wood was obtained in the same manner as in Comparative Example 1.

TABLE I

| | Wood | | | Adhesion Compounds | | |
|---|---|---|---|---|---|---|
| Pre-treat. | Species | Size (cm) | Sur. Grain Treated | Anion-Contain. Comp. | (g/ft$^2$) | layer (μm) |

TABLE I-continued

| Ex. No. | | | | | | | |
|---|---|---|---|---|---|---|---|
| 1 | Yes | Agatis | 30 × 30 × 0.3 | Flat/Strght. | $(NH_4)_2HPO_4$ | (35) | 250–350 |
| 2 | Yes | Hemlock | 30 × 30 × 1.5 | Flat/Strght. | $(NH_4)_2HPO_4$<br>$H_3BO_3$ | (95)<br>(5) | 750–850 |
| 3 | Yes | Agatis | 30 × 30 × 1.5 | Cross Sect. | $(NH_4)_2HPO_4$<br>$H_3BO_3$ | (180)<br>(50) | 1800–2000 |
| 4 | Yes | Hemlock | 30 × 30 × 1.5 | Cross Sect. | $(NH_4)_2HPO_4$ | (50) | 350–450 |
| 5 | Yes | Agatis | 30 × 30 × 0.3 | Flat/Strght. | $(NH_4)_2HPO_4$ | (35) | 250–350 |
| 6 | Yes | Agatis | 30 × 30 × 0.3 | Flat/Strght. | $(NH_4)_2HPO_4$ | (90) | 650–750 |
| 7 | No | Agatis | 30 × 30 × 0.3 | Flat/Strght. | $(NH_4)_2HPO_4$ | (35) | 250–350 |
| 8 | No | Agatis | 30 × 30 × 0.2 | Flat/Strght. | $Na_2HPO_4$ | (30) | 250–350 |
| 9 | No | Hemlock | 30 × 30 × 0.3 | Flat/Strght. | $(NH_4)_2HPO_4$ | (30) | 200–300 |
| 10 | No | Hemlock | 30 × 30 × 0.3 | Flat/Strght. | $(NH_4)_2HPO_4$<br>$H_3BO_3$ | (30)<br>(15) | 350–450 |
| 11 | No | Jp. Ceder | 30 × 30 × 0.5 | Flat/Strght. | $(NH_4)_2HPO_4$ | (60) | 450–550 |
| Comp. Ex. | | | | | | | |
| 1 | Yes | Agatis | 30 × 30 × 0.3 | All Surfaces | $(NH_4)_2HPO_4$<br>$H_3BO_3$ | (3.5)<br>(4.0) | |
| 2 | Yes | Hemlock | 30 × 30 × 1.5 | All Surfaces | $Na_2HPO_4$<br>$H_3BO_3$ | (2.0)<br>(2.0) | |

| | Adhesion Compounds | | | Treat'g Condi. | |
|---|---|---|---|---|---|
| | Cation-Contain. Comp. | (g/ft²) | layer (μm) | Temp. (°C.) | Time (Hr) |
| Ex. No. | | | | | |
| 1 | $BaCl_2.2H_2O$ | (65) | 300–400 | Room | 24 |
| 2 | $BaCl_2.2H_2O$<br>$H_3BO_3$ | (170)<br>(5) | 1200–1400 | Room | 72 |
| 3 | $BaCl_2.2H_2O$<br>$H_3BO_3$ | (300)<br>(50) | 1800–2000 | Room | 72 |
| 4 | $CaCl_2$ | (180) | 1100–1300 | 60 | 24 |
| 5 | $BaCl_2.2H_2O$ | (65) | 300–400 | 60 | 24 |
| 6 | $CaCl_2$ | (90) | 550–650 | Room | 72 |
| 7 | $BaCl_2.2H_2O$ | (65) | 300–400 | 60 | 24 |
| 8 | $BaCl_2.2H_2O$ | (50) | 200–300 | 60 | 12 |
| 9 | $CaCl_2$ | (30) | 200–300 | 80 | 24 |
| 10 | $CaCl_2$<br>$H_3BO_3$ | (30)<br>(15) | 250–350 | 80 | 24 |
| 11 | $BaCl_2.2H_2O$ | (100) | 450–550 | 60 | 48 |
| Comp. Ex. | | | | | |
| 1 | $BaCl_2$<br>$H_3BO_3$ | (2.0)<br>(2.0) | | 80 | 24 |
| 2 | $CaCl_2$<br>$H_3BO_3$ | (2.0)<br>(2.0) | | 80 | 24 |

In the above Table I, Example 6 was carried out with an aqueous solution containing the both anion-containing and cation-containing forming compounds employed. Further, the both anion-containing and cation-containing forming compound solutions in Comparative Examples 1 and 2 show mol amount in 1 liter of water. In Examples 1–5 and 7–11, on the other hand, the anion-containing and cation-containing forming compounds in powdery state as a solid member were employed as spread over the wood surfaces. In Examples 7–11, further, the curing treatment was carried out in an atmosphere of the relative humidity of 95%.

With respect to the respective modified woods obtained through the foregoing Examples 1–11 and Comparative Examples 1 and 2, determinations the content and contained-state of the insoluble inorganic compound, rotproof and mothproof properties (particularly with respect to ants) and nonflammability were made. In determining the content of the insoluble inorganic compound, calculations by means of a following formula were carried out:

$$\text{Content } (\%) = \{(w_2 - w_1)/w_1\} \times 100$$

in which $w_1$ is the absolute dry weight of the wood before being treated, and $w_2$ is the absolute dry weight of the wood after being treated. The rotproof and antproof properties were determined in accordance with NOs. 3 and 11 of JWPA Standard, with the effectiveness indication by VG for the one above 98, G for above 90 and below 98 and B for below 90. The nonflammability was obtained in accordance with the surface test of JIS-A1321, with the nonflammability indication by G for those above Grade 3 and by B for those not of Grade 3 but has a nonflammability. Results of these discriminations were as shown in the following Table II:

TABLE II

| | Insoluble Inorg. Comp. | | | | |
|---|---|---|---|---|---|
| | Content (%) | Contained State | Rot-proof | Moth-proof | Non-flammblty. |
| Ex. No. | | | | | |
| 1 | 50–60 | A | G | G | G |
| 2 | 20–30 | A | G | G | G |
| 3 | 50–60 | A | G | G | G |
| 4 | 10–15 | A | G | G | G |
| 5 | 50–60 | A | G | G | G |
| 6 | 30–40 | A | G | G | G |
| 7 | 50–60 | A | G | G | G |
| 8 | 65–70 | A | G | G | G |
| 9 | 35–40 | A | G | G | G |
| 10 | 35–40 | A | VG | VG | G |
| 11 | 60–70 | A | G | G | G |
| Comp. Ex. | | | | | |
| 1 | 60–70 | B | G | G | G |
| 2 | 30–40 | B | G | G | G |

In the above Table II, the contained state "A" of the insoluble inorganic compound denotes that the production of the particular compound is seen at deep part of more than 1 mm from the surface of the wood, while the state "B" denotes that the production is seen to the extent of about 1 mm.

In the respective modified woods obtained through Examples 1 to 11 according to the present invention, as will be clear from the above Table II, the insoluble inorganic compound showing the nonflammability can be produced to deeper part and even to central part of the wood, in contrast to the modified woods obtained through Comparative Examples 1 and 2, and it has been found that, even when the content itself of the insoluble inorganic compound is not so much, substantially the same level of the rotproof and mothproof properties and nonflammability as those in the case where the content is high can be obtained.

EXAMPLE 12

Three sheets of the rotary-cut agatis wood veneers P1, P2 and P3 of 30 cm long, 30 cm wide and 0.3 cm thick were employed as the wood, and these veneers were immersed in hot water to have their saturated state reached. Then, a melamine resin employed as a first compound was uniformly spread over one surface of the first veneer P1 at a rate of 144 g/ft$^2$, ammonium chloride as a second compound was uniformly spread over one surface of the second veneer P2 at a rate of 4.4 g/ft$^2$, and the melamine resin as the first compound was spread over one surface of the third veneer P3 at a rate of 72 g/ft$^2$. Then, on a vinyl sheet over which ammonium chloride as the second compound was uniformly spread at a rate 2.2 g/ft$^2$, the first to third veneers P1–P3 were stacked in the order of the first, second and third veneers with their one side surfaces having the spread compounds faced upward. The thus stacked veneers were kept in a sealed state under a temperature condition of 60° C. to be cured for 2 hours for causing the resin to be set, i.e., to rendered to be insoluble. Thereafter, the three sheets of the veneers were respectively rinsed and dried at 150° C., and thereby a modified wood was obtained. In this case, the melamine resin as the first compound was made to form a layer of 900–1000 μm and ammonium chloride as the second compound was made to be a layer of 20–40 μm on the surfaces of the veneers.

EXAMPLE 13 AND 14

Except for such changes in conditions and so on as shown in a following Table III, modified woods were obtained in the same manner as in Example 12. In this Example 14, a raw wood material not treated for the water-saturation was employed as the wood.

COMPARATIVE EXAMPLE 3

A rotary-cut agatis wood veneer of 30 cm long, 30 cm wide and 0.3 cm thick was employed as the wood, and this veneer was impregnated with a solution containing 20 wt. % of melamine resin and 5 wt. % of phosphoric acid under a reduced pressure. Thereafter, the veneer was rinsed and dried at 120° C. for 4 hours, and a modified wood was thereby obtained.

COMPARATIVE EXAMPLE 4

Except for such changes in treating conditions as listed in a following Table III, a modified wood was obtained in the same manner as in Comparative Example 3.

TABLE III

| | | Wood | | | Adhesion Compounds | | |
|---|---|---|---|---|---|---|---|
| | Pre-treat. | Species | Size (cm) | Sur. Grain Treated | 1st Comp. (g/ft$^2$) | | layer (μm) |
| Ex. No. | | | | | | | |
| 12 | Yes | Agatis | 30 × 30 × 0.3 | Flat/Strght. | Melamine r. | (72) | 900–1000 |
| 13 | Yes | Lauan | 30 × 30 × 0.3 | Flat/Strght. | $NH_4Cl$ | (2.4) | 450–550 |
| | | | | | $(NH_4)_2HPO_4$ | (55) | |
| 14 | No | Hemlock | 30 × 30 × 0.3 | Flat/Strght. | Phosph. acd. | (30) | 300–400 |
| | | | | | $NH_4Cl$ | (2.4) | |
| Comp. Ex. No. | | | | | | | |
| 3 | No | Agatis | 30 × 30 × 0.3 | All Surfaces | Melamine r. | (20) | |
| 4 | No | Agatis | 30 × 30 × 0.3 | All Surfaces | Melamine r. | (20) | |
| | | | | | $NH_4Cl$ | (3) | |

| | Adhesion Compounds | Treat'g Conditi. |
|---|---|---|

TABLE III-continued

| | 2nd Comp. | (g/ft²) | layer (μm) | Temp. (°C.) | Time (Hr) |
|---|---|---|---|---|---|
| Ex. No. | | | | | |
| 12 | $NH_4Cl$ | (2.2) | 20–40 | 60 | 2 |
| 13 | Melamine r. | (80) | 1000–1200 | 60 | 2 |
| 14 | Melamine r. / Methylolacryl-amide | (30) / (10) | 850–1000 | 80 | 2 |
| Comp. Ex. No. | | | | | |
| 3 | Phosph. acd. | (5) | | 120 | 4 |
| 4 | $(NH_4)_2HPO_4$ | (7) | | 120 | 4 |

In Example 13, the veneers were dried at 130° C. for 3 hours and, in Example 14, they were dried at 120° C. for 3 hours. In Comparative Examples 3 and 4, the amount of the first and second compounds is denoted by wt. % in their mixture solution.

With respect to the respective modified woods obtained through the foregoing Examples 12–14 and Comparative Examples 3 and 4, discriminations were made in connection with the content of the insoluble inorganic compound, treating efficiency, presence or absence of any setting of the compound before impregnation into the wood, and presence or absence of any reaction outside the wood, results of which discriminations were as shown in a following Table IV, in which the treating efficiency is represented by G for excellent ones and by W for inferior ones:

TABLE IV

| | Content (%) of Insible. Inorg. Comp. | Treat'g Eff. | Pres./Abs. of Set'g bef. Impreg. | Pres./Abs. of React'n outsd. |
|---|---|---|---|---|
| Ex. No. | | | | |
| 12 | 35–45 | G | Absent | Absent |
| 13 | 30–35 | G | Absent | Absent |
| 14 | 40–50 | G | Absent | Absent |
| Comp. Ex. No. | | | | |
| 3 | 35–40 | G | Absent | Present |
| 4 | 30–35 | W | Present | Present |

For the state in which the insoluble inorganic compound is contained in the modified woods according to the foregoing Examples 12–14 and Comparative Examples 3 and 4, they have shown excellent state of reaching a depth more than 1 mm in all cases. Consequently, they were also excellent in the rotproof and mothproof properties and in the nonflammability. In the case of Comparative Example 3, the wood has shown remarkable change in color and deterioration of quality due to a pH decrease for the purpose of preventing the forming compounds from being set. As is clear from the above Table IV, it has been found that the insoluble inorganic compound is caused to be highly efficiently contained in the modified woods obtained through Examples 12–14 to reach deeper portion in the wood than in the case of the modified woods according to Comparative Examples 3 and 4.

EXAMPLE 15

Three sheets P11, P12 and P13 of the rotary-cut agatis wood veneers each being 30 cm long, 30 cm wide and 0.3 mm thick were used as the wood, the veneers were immersed in hot water to reach a saturated state. Melamine resin as the first forming compound was uniformly spread over one side surface of first one P11 of the veneers at a rate of 72 g/ft², ammonium chloride as the second forming compound was uniformly spread over one side surface of the second veneer sheet P12 at a rate of 2.2 g/ft², and melamine resin as the first forming compound was uniformly spread over one side surface of the third veneer sheet P13 at a rate of 36 g/ft². These veneers P11–P13 were then stacked on a vinyl sheet over which the second forming compound, ammonium chloride, was spread uniformly at a rate of 1.1 g/ft², in the order of from the first sheet to the third sheet. The thus stacked vinyl and veneer sheets were kept in a tightly sealed state under a temperature condition of 60° C., so as to be cured for 2 hours. Thereafter, the first and third veneer sheets P11 and P13 among the respective veneer sheets P11–P13 were turned over 180 degrees and again stacked with their surfaces carrying mutually the different compounds brought into contact with each other, and thus stacked veneers were kept as sealed under the temperature condition of 60° C. to be cured for 4 hours. Thereafter, the three veneers were respectively rinsed and dried at 150° C. for 3 hours, so as to be the veneers of a modified wood.

EXAMPLES 16–18

Except for such conditional changes as in a following Table V, further modified woods were obtained in the same manner as in Example 15.

COMPARATIVE EXAMPLE 5

A rotary-cut agatis wood veneer of 30 cm long, 30 cm wide and 0.3 cm thick was employed as the wood, and this veneer was immersed for 24 hours sequentially in a first forming compound solution of 2 mol/lit. of $BaCl_2.2H_2$ and 2 mol/lit. of $H_3BO_3$ and in a second forming compound solution of 3.5 mol/lit. of $(NH_4)_2HPO_4$ and 4 mol of $H_3BO_3$ per 1 lit. of water, the both solutions being kept heated at 80° C. Thus immersed veneer was thereafter rinsed and dried to be a modified wood.

COMPARATIVE EXAMPLE 6

Except for a use of lauan wood veneer as the wood of 30 cm long, 30 cm wide and 0.3 cm thick and omission of such twice carried-out curing as in Example 15 as well as such conditional changes in the type of the forming compounds as listed in a following Table V, a modified wood was obtained in the same manner as in Example 15.

TABLE V

| | Pre-treat. | Wood: Species | Wood: Size (cm) | Wood: Sur. Grain Treated | Adhesion Compounds: 1st Comp. | (g/ft$^2$) | layer (μm) |
|---|---|---|---|---|---|---|---|
| Ex. No. | | | | | | | |
| 15 | Yes | Agatis | 30 × 30 × 0.3 | Flat/Strght. | Melamine r. | (73) | 900–1000 |
| 16 | Yes | Lauan | 30 × 30 × 0.3 | Flat/Strght. | $(NH_4)_2HPO_4$<br>$NH_4Cl$ | (56)<br>(2.3) | 400–500 |
| 17 | No | Hemlock | 30 × 30 × 0.3 | Flat/Strght. | $Na_2SO_4$<br>$(NH_4)_2HPO_4$ | (30)<br>(28) | 500–600 |
| 18 | No | Agatis | 30 × 30 × 0.3 | Flat/Strght. | $BaCl_2.2H_2O$ | (46) | 200–300 |
| Comp. Ex. No. | | | | | | | |
| 5 | Yes | Agatis | 30 × 30 × 0.3 | All Surfaces | $BaCl_2.2H_2O$<br>$H_3BO_3$ | | |
| 6 | No | Lauan | 30 × 30 × 0.3 | Flat/Strght. | $BaCl_2.2H_2O$ | (92) | |

| | Adhesion Compounds: 2nd Comp. | (g/ft$^2$) | layer (μm) | Treat'g Conditions: Temp. (°C.) | Time (Hr) |
|---|---|---|---|---|---|
| Ex. No. | | | | | |
| 15 | $NH_4Cl$ | (2.3) | 20–40 | 60<br>60 | 2<br>4 |
| 16 | Melamine r. | (82) | 900–1100 | 60<br>60 | 4<br>4 |
| 17 | $CaCl_2$ | (48) | 300–400 | Room<br>Room | 7<br>3 |
| 18 | $Na_2HPO_4$<br>$H_3BO_3$ | (27)<br>(11) | | 80<br>80 | 2<br>5 |
| Comp. Ex. No. | | | | | |
| 5 | $(NH_4)_2HPO_4$<br>$H_3BO_3$ | | | — | — |
| 6 | $K_2HPO_4$ | (54) | | 60 | 24 |

In the above Table V, Comparative Example 5 is employing solutions of the both forming compounds and no amount of adhesion per unit area of the compounds is shown. Further, in Example 18, the curing was carried out without the sealing and under an atmosphere of relative humidity of 95%. In Comparative Example 5, the curing was omitted and the veneer was dried at 120° C. for 4 hours. On the other hand, the drying treatment was carried out at 150° C. for 3 hours after the curing in Example 15, at 130° C. for 3 hours after the curing in Example 16, and at 105° C. for 4 hours after the curing in Examples 17 and 18 and Comparative Example 6.

Determinations of the content of the insoluble inorganic compound, presence or absence of any setting of the forming compounds before impregnation into the wood, and presence or absence of any reaction taken place outside the wood were made with respect to the respective modified woods according to the foregoing Examples 15–18 and Comparative Examples 5 and 6, results of which were as shown in a following Table VI:

TABLE VI

| | Content (%) of Insoluble Inorg. Comp. | Pres./Abs. of Set'g Bef. Impregnation | Pres./Abs. of Outside Reaction |
|---|---|---|---|
| Ex. No. | | | |
| 15 | 50–60 | Absent | Absent |
| 16 | 50–60 | Absent | Absent |
| 17 | 65–85 | Absent | Absent |
| 18 | 70–90 | Absent | Absent |
| Comp. Ex. No. | | | |
| 5 | 35–40 | Present | Present |
| 6 | 40–50 | Absent | Present |

For the containing state of the insoluble inorganic compound in the modified woods according to the foregoing Examples 15–18 and Comparative Examples 5 and 6, they have shown excellent state of reaching the depth of more than 1 mm, except for the case of Comparative Example 5, and it should be appreciated that, in the embodiment according to the present invention, the content and containing depth of the insoluble inorganic compoud have been further increased.

What is claimed is:

1. A method for impregnating wood, comprising the steps of:

(a) providing a plurality of wood pieces containing a solvent in which are soluble two compounds which chemically react to form an insoluble reaction product;

(b) stacking the wood pieces and providing a layer of one or the other of said two compounds between each of the stacked wood pieces in alternating fashion, such that one side of each wood piece is contacted with one of said compounds and the other side of each wood piece is contacted with the other of said compounds;

(c) reacting the two compounds within the wood to form the insoluble reaction product; and (d) curing the wood pieces to fix the insoluble reaction product therein.

2. The method according to claim 1, wherein said step of providing said wood pieces includes a step of preliminarily impregnating the wood pieces sufficiently with said solvent.

3. The method according to claim 1, wherein said curing step is performed within an atmosphere of a high temperature and a high solvent humidity.

4. The method according to claim 1, wherein said insoluble reaction product formed and fixed within the wood pieces is inorganic.

5. The method according to claim 1, wherein said insoluble reaction product formed and fixed within the wood pieces is organic.

6. The method according to claim 4 wherein said two compounds are a cation-containing compound and an anion-containing compound which reacts with said cation-containing compound to form said insoluble reaction product.

7. The method according to claim 6 wherein said cationic compound includes a cation selected from the group consisting of alkali metal, alkali earth metal, Al and Zn, and said anionic compound includes an anion selected from a group consisting of $BO_3$, $PO_4$, $CO_3$, $SO_4$, F, Cl, Br, and OH.

8. The method according to claim 1, further including the steps of:

(e) reversing the position of alternating wood pieces in the wood stack, such that a surface of one wood piece having thereon a coating of one of said two compounds contacts a surface of another wood piece having thereon a coating of the other of said two compounds;

(f) further reacting the two compounds to form additional insoluble reaction product; and (g) further curing the wood pieces to fix the additional insoluble reaction product.

9. The method of claim 1, further including coating the outward-facing surfaces of the wood pieces at the ends of said stacked wood with the one of said two compounds different from that forming the layer on the opposing, inward-facing side of the end wood pieces.

10. The method according to claim 6 wherein said cation-containing and anion-containing compounds are used in a solid state.

11. The method according to claim 6 wherein said cation-containing and anion-containing compounds are used in a slurry state.

* * * * *